US005598504A

United States Patent [19]

Miyano

[11] Patent Number: 5,598,504

[45] Date of Patent: Jan. 28, 1997

[54] SPEECH CODING SYSTEM TO REDUCE DISTORTION THROUGH SIGNAL OVERLAP

[75] Inventor: Toshiki Miyano, Tokyo, Japan

[73] Assignee: NEC Corporation, Tokyo, Japan

[21] Appl. No.: 212,723

[22] Filed: Mar. 14, 1994

[30] Foreign Application Priority Data

Mar. 15, 1993 [JP] Japan ..... 008736

[51] Int. Cl.[6] ..... G10L 9/00

[52] U.S. Cl. ..... 395/2.31; 395/2.28

[58] Field of Search ..... 395/2.31, 2.28, 395/2.32; 381/40, 41, 36, 47

[56] References Cited

U.S. PATENT DOCUMENTS 5,265,190 11/1993 Yip et al. ..... 395/2.28

OTHER PUBLICATIONS

W. B. Kleijn et al., "Improved Speech Quality and Efficient Vector Quantization in SELP", *Proc. ICASSP for Acoustic, Speech and Signal Processing,* 1988 IEEE, pp. 155–158.

M. R. Schroeder et al., "Code–Excited Linear Prediction (CELP): High–Quality Speech at Very Low Bit Rates", *Proc. ICASSP for Acoustic, Speech and Signal Processing,* 1985 IEEE, pp. 937–940.

W. P. LeBlanc et al., "Structured Codebook Design in CELP", *International Mobile Satellite Conference,* Ottawa, 1990, pp. 667–672.

I. M. Trancoso et al., "Efficient Search Procedures for Selecting . . . in Stochastic Coders", *IEEE Transactions on Acoustics, Speech, & Signal Processing,* vol. 38, No. 3, Mar. 1990, pp. 385–396.

T. Miyano et al., "Improved 4.8kb/s CELP Coding Using Two–Stage Vector Quantization with Multiple Candidates (LCELP)", 1992 IEEE, pp.I–321 to I–324.

*Primary Examiner*—Allen R. MacDonald
*Assistant Examiner*—Patrick N. Edouard
*Attorney, Agent, or Firm*—Sughrue, Mion, Zinn, Macpeak & Seas

[57] ABSTRACT

An adaptive codebook having excitation signal predetermined in the past, an excitation codebook for vector quantizing an excitation signal of the input speech signal and a gain codebook for vector quantizing gains of the adaptive and excitation codebooks are provided. A perceptually weighted speech signal having a subframe length obtained by dividing the frame is developed by using the input speech signal and the spectral parameters. A zero input signal of a synthesis filter is developed for a predetermined length by providing the input speech signal of the present subframe as an initial value to the synthesis filter on the basis of the spectral parameters. An overlap signal is also developed by weighting the zero input signal on the basis of the spectral parameters. Optimal codevectors are searched from the adaptive, excitation and gain codebooks according to a signal obtained by connecting the overlap signal to the trailing end of the perceptually weighted speech signal.

7 Claims, 1 Drawing Sheet

SPEECH CODING SYSTEM TO REDUCE DISTORTION THROUGH SIGNAL OVERLAP

BACKGROUND OF THE INVENTION

The present invention relates to a speech coding system for high quality coding speech signals at a low bit rate, particularly a bit rate of 8 kb/sec or less, with a comparatively small amount of operations.

As a prior art speech coding system for vector quantizing an excitation signal with an excitation codebook, a CELP system is well known. This system is disclosed in a treatise by M. R. Shroeder and B. S. Atal entitled "Code-Excited Linear Prediction (CELP): High-Quality Speech at Very Low Bit Rates", Proc. ICASSP for Acoustic, Speech and Signal Processing, 1985, p—p 937–940 (literature 1). Also, as a CELP system having an adaptive codebook, a CELP system is well known, which is disclosed in a treatise by W. B. Kleijn et al entitled "Improved Speech Quality and Efficient Vector Quantization in SELP", Proc. ICASSP for Acoustic, Speech and Signal Processing, 1988, p—p 155–158 (literature 2). In these CELP systems, optimal codevectors are searched from excitation, adaptive and gain codebooks to minimize the perceptually weighted square distance between the input and coded speech signals for each subframe length. However, since the coding is done for each subframe, distortion is liable to result at the block boundary in the block coding, and therefore sufficiently satisfactory speech sound quality can not be obtained. To alleviate the distortion at the block boundary of the block coding, a speech coding system has been proposed in a treatise by LeBlanc et al entitled "Structured Codebook Design in CELP". International Mobile Satellite Conference, 1990, p—p 667–672 (literature 3). In this system, an optimal codevector is searched from an excitation codebook to minimize the perceptually weighted square distance between two signals. The first signal is obtained by connecting the next subframe input speech signal for a predetermined length called overlap length to the present subframe input speech signal. The second signal, is obtained by connecting an influence signal of a coded speech signal having a length corresponding to the overlap length to the trailing end of the coded speech signal.

In the prior art systems noted above, the distortion at the block boundary of the block coding still cannot be sufficiently reduced although the distortion can be reduced to a certain degree.

SUMMARY OF THE INVENTION

An object of the present invention is therefore to provide a speech coding system capable of solving the above problem and obtaining satisfactory speech sound quality compared with that in the prior art at a bit rate of 8 kb/sec or less with a comparatively small amount of operations.

According to the present invention, there is provided a speech coding system comprising a linear prediction analysis section for developing spectral parameters of an input speech signal divided at a predetermined interval in each frame, an adaptive codebook having excitation signals predetermined in the past, an excitation codebook for vector quantizing an excitation signal of the input speech signal, a gain codebook for vector quantizing gains of the adaptive and excitation codebooks, and a synthesis filter for producing a synthetic signal. In this arrangement a perceptually weighted speech signal having a subframe length obtained by dividing the frame is developed by using the input speech signal and the spectral parameters, a zero input signal of a synthesis filter is developed for a predetermined length by providing the input speech signal of the present subframe as an initial value to the synthesis filter on the basis of the spectral parameters, and an overlap signal is developed by weighting the zero input signal on the basis of the spectral parameters, and optimal codevectors are searched from the adaptive, excitation and gain codebooks according to a signal obtained by connecting the overlap signal to the trailing end of the perceptually weighted speech signal.

In another aspect of the present invention, there is provided a speech coding system comprising: a linear prediction analysis means for executing linear prediction analysis on each subframe of an input speech signal to produce LPC coefficient sets; a spectral parameter quantizer means for quantizing the spectral parameters corresponding to the LPC coefficient sets, and for converting the quantized spectral parameters into LPC coefficient sets; a first weighting filter means for executing a perceptual weighting of the subframe speech signal on the basis of the non-quantized LPC coefficient set of the present subframe supplied from the linear prediction analysis means; a synthesis filter means for producing a synthetic signal for a predetermined overlap length by setting the input speech signal of the present subframe speech signal as an initial value, and for setting the excitation signal to zero on the basis of the non-quantized LPC coefficient set of the next subframe speech signal; a second weighting filter means for weighting the synthetic signal on the basis of the non-quantized LPC coefficient set of the next subframe supplied from the linear prediction analysis means; a connection circuit means for connecting the signal output from the second weighting filter means to a trailing end of the signal supplied from the first weighting filter means; an influence signal subtraction circuit means for developing an influence signal from the previous subframe on the basis of the quantized LPC coefficient sets of the present and next subframes supplied from the spectral parameter quantizer means, weighting the influence signal on the basis of the non-quantized LPC coefficient sets of the present and next subframes supplied from the linear prediction analysis means to obtain a weighted influence signal, and subtracting the weighted influence signal from the output signal from the connection circuit means; an adaptive codebook search means for searching for an optimal adaptive codevector from an adaptive codebook on the basis of the signal supplied from the influence signal subtraction circuit means, the non-quantized LPC coefficient sets of the present and next subframes supplied from the linear prediction means, the quantized LPC coefficient sets of the present and next subframes supplied from the spectral parameter quantizer means and an adaptive codevector supplied from the adaptive codebook; and an excitation codebook search means for searching for an optimal excitation codevector from an excitation codevector on the basis of the signal supplied from the influence signal subtraction means, the non-quantized LPC coefficient sets of the present and next subframes supplied from the linear prediction analysis means, the quantized LPC coefficient sets of the present and next subframes supplied from the spectral parameter quantizer means, the selected adaptive codevector supplied from the adaptive codevector search means and excitation codevector supplied from the excitation codebook, and supplying the searched excitation codevector to the gain codebook search means and also supplying an index of the searched excitation codevector to a multiplexer means.

Other objects and features will be clarified from the following description with reference to attached drawings.

DETAILED DESCRIPTION OF THE PREFERRED EMBODIMENTS

Figure 1:
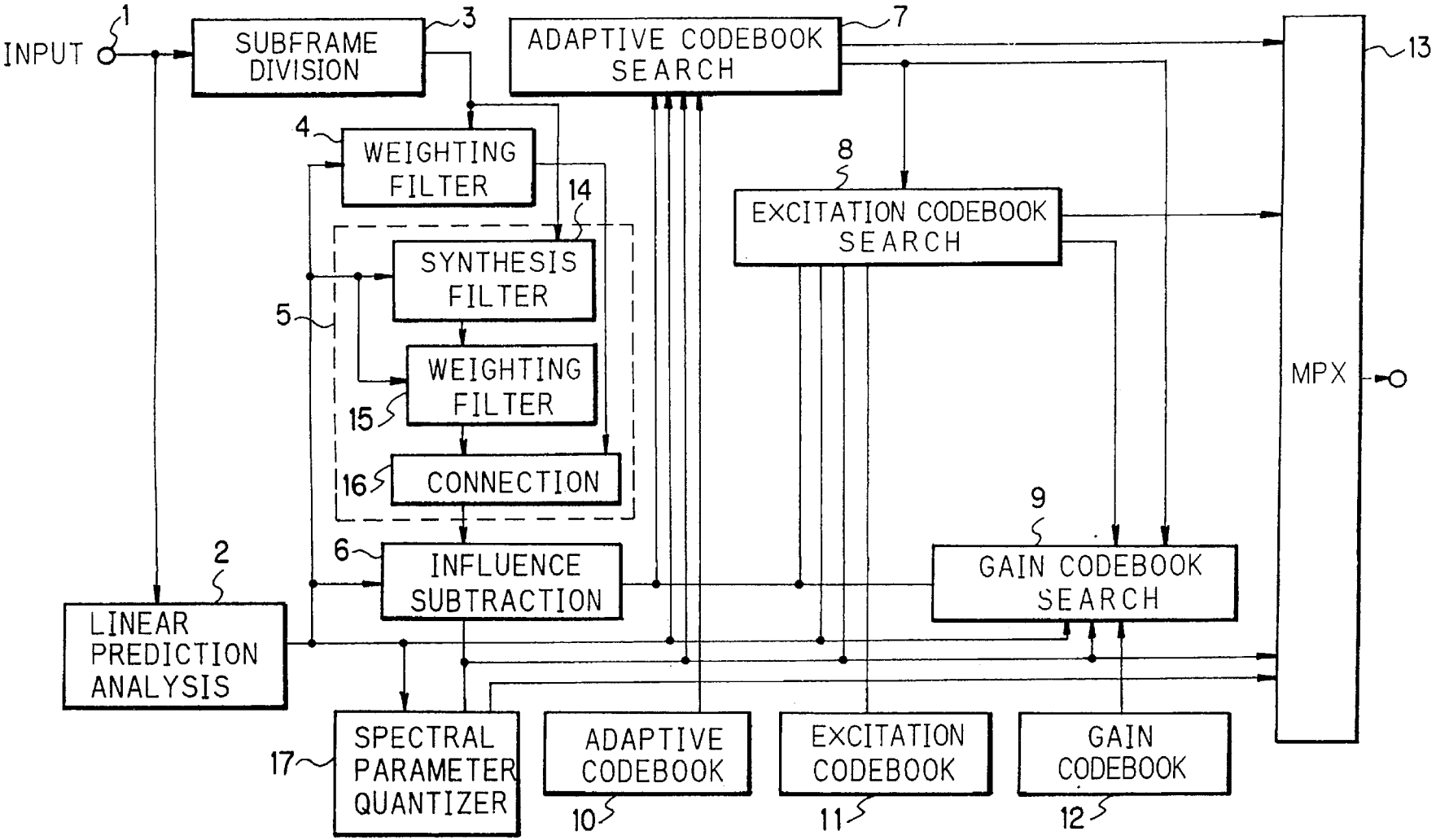
FIG. 1 is a block diagram showing an embodiment of the present invention.

A principle of the speech coding system according to the present invention will be described.

An input speech signal x which is divided into subframes, is weighted by the perceptual weighting filter W using a non-quantized LPC (Linear Prediction Coding) coefficient set of the present subframe to produce a weighted input speech signal $x_w$.

The perceptual weighting filter W has a transfer function W(z) given as the following formula (1), $$W(z)=\frac{1-\sum_{i=1}^{p}\alpha_i(z/\beta)^{-i}}{1-\sum_{i=1}^{p}\alpha_i(z/\gamma)^{-i}} \tag{1}$$

In this formula, $\alpha_i$ is a non-quantized LPC coefficient set of the present subframe, $\beta$ and $\gamma$ are weighting coefficients, and p is an order of LPC.

Using the input speech signal of the present subframe as an initial value, a zero input response of a synthesis filter S' using the non-quantized LPC coefficient set of the next subframe is developed for the length of overlap length $L_O$. An overlap signal v is then produced by weighting with the perceptual weighting filter W' using the non-quantized LPC coefficient set of the next subframe. When the present subframe is the final subframe, the non-quantized LPC coefficient set of the present subframe is used in lieu of the non-quantized LPC coefficient set of the next subframe.

The overlap signal disclosed in the literature 3, is the input speech signal of the next subframe. However, according to the present invention the signal, which is to be represented by the adaptive, excitation and gain codevectors of the present subframe, is an influence signal on the next subframe that is based on the present subframe input speech signal. Thus, for efficient reduction of the distortion at the block boundary of the block coding, generated as a result of coding for each subframe, it is preferred to adopt an influence signal on the next subframe based on the present subframe input speech signal as the overlap signal.

The overlap signal v is connected to the trailing end of the weighted input signal $x_w$ to produce a signal $x_e$ called an expanded weighted input signal.

With the previous subframe signal as an initial value, the zero input response of the synthesis filter S, using the non-quantized coefficient set of the present subframe, is obtained for the length of the subframe length $L_s$. With the signal thus obtained as an initial value, the zero input response of the synthesis filter S' using the quantized LPC coefficient set of the next subframe is obtained for the length of the overlap length $L_O$. Further, the subframe length portion is weighted with the perceptual weighting filter W using the non-quantized LPC coefficient set of the present subframe, while the overlap length portion is weighted with the perceptual weighting filter W' using the non-quantized LPC coefficient set of the next subframe, thus obtaining a weighted influence signal f. The weighted influence signal f is subtracted from the expanded weighted input signal $x_e$. The signal obtained by subtracting the weighted influence signal f from the expanded weighted input signal $x_e$ is referred to as signal y. If the present subframe is the final subframe, the non-quantized LPC coefficient set of the present subframe is used in lieu of the non-quantized LPC coefficient set of the next subframe, while using the quantized LPC coefficient set of the present subframe in lieu of the quantized LPC coefficient set of the next subframe.

First, an adaptive codevector which can minimize the error $E_a$ in formula (2) is searched.

$$E_a=\|y-g_a sa_d\|^2_{Ls+Lo}. \tag{2}$$

where, $$\|x\|^2_{Ls+Lo}=\sum_{i=0}^{Ls+Lo-1}x(i)^2. \tag{3}$$

In the formula, $sa_d$ is a perceptually weighted synthetic signal, which is obtained with the synthesis filters S and S' and perceptual weighting filters W and W' from an expanded adaptive codevector $a_d$ obtained by providing $L_O$ "O"s in succession after an adaptive codevector having a delay d, and $g_a$ is an optimum gain of the perceptually weighted synthetic signal of the expanded adaptive codevector $a_d$.

The optimum gain $g_a$ of the perceptually weighted synthetic signal $sa_d$ of the expanded adaptive codevector $a_d$ is given as:

$$g_a=\frac{<y,sa_d>_{Ls+Lo}}{<sa_d,sa_d>_{Ls+Lo}} \tag{4}$$

By substituting this formula into formula (2), the following formula is obtained:

$$E_a=\|y\|^2_{Ls+Lo}-\frac{<y,sa_d>^2_{Ls+Lo}}{<sa_d,sa_d>_{Ls+Lo}}. \tag{5}$$

where, $$<x,y>_{Ls+Lo}=\sum_{i=0}^{Ls+Lo-1}x(i)y(i). \tag{6}$$

Next, an excitation codevector which can minimize the error $E_e$ in the following formula (7) with respect to the selected adaptive codevector is searched.

$$E_e=\|y-g_{\alpha}s\alpha_d-g_e se_i^{\perp}\|_{L\alpha+Lo}{}^2 \tag{7}$$

In this formula, $se_i^{\perp}$ is an orthogonalized perceptually weighted synthetic signal of expanded excitation codevector $e_i$, which is obtained by orthogonalizing the perceptually weighted synthetic signal $se_i$ which is obtained with the synthesis filters S, S' and perceptual weighting filters W, W' from the expanded excitation codevector $e_i$ produced by providing $L_0$ "O"s in succession after the excitation codevector of index i, with respect to the perceptually weighted synthetic signal $sa_d$ of the selected expanded adaptive codevector $sa_d$, and $g_e$ is the optimum gain of the orthogonalized perceptually weighted synthetic signal $se_i^{\perp}$. The gain $g_e$ is given by the following formula (8).

$$g_e=\frac{<y,se_i^{\perp}>_{Ls+Lo}}{<se_i^{\perp},se_i^{\perp}>_{Ls+Lo}} \tag{8}$$

This formula is substituted into the formula (7) to develop the following formulae:

$$E_e=\|y\|^2_{Ls+Lo}-\frac{<y,sa_d>^2_{Ls+Lo}}{<sa_d,sa_d>_{Ls+Lo}}-\frac{<y,se_i^{\perp}>^2_{Ls+Lo}}{<se_i^{\perp},se_i^{\perp}>_{Ls+Lo}} \tag{9}$$

where, $$<y,se_i^{\perp}>_{Ls+Lo}= \tag{10}$$

-continued $$<y,se_i>_{Ls+Lo} - \frac{<se_i,sa_d>_{Ls+Lo}}{<sa_d,sa_d>_{Ls+Lo}} <y,sa_d>_{Ls+Lo},$$

$$<se_i^{\perp},se_i^{\perp}>_{Ls+Lo} = <se_i,se_i>_{Ls+Lo} - \frac{<se_i,sa_d>^2_{Ls+Lo}}{<sa_d,sa_d>_{Ls+Lo}}. \quad (11)$$

Finally, a gain codevector which can minimize the error $E_g$ in the following formula (12), is searched with respect to the selected expanded adaptive and excitation codevectors $a_d$ and $e_i$.

$$E_g = \|y - G1_k s\alpha_d - G2_k se_i\|_{Ls+Lo}^2 \quad (12)$$

Here, $(G1_k, G2_k)$ is the gain codevector of index k.

As the vector $(G1_k, G2_k)$ may be used, instead of the gain codevector itself, a gain codevector which is obtained through conversion of a matrix calculated by using, for instance, a quantized power of the weighted input signal, a power of residual signal estimated from an LPC coefficient set, powers of the expanded adaptive and excitation codevectors.

Now, in the following description, when a present subframe is the final subframe, the term "non-quantized LPC (linear prediction coding) coefficient set of the next subframe" refers to the non-quantized LPC coefficient set of the present sub-frame, and the term "quantized LPC coefficient of the next subframe" refers to the quantized LPC coefficient set of the present subframe.

Referring to FIG. 1 a speech signal which has been divided for each frame (for instance of 40 msec.), which appears at an input terminal 1, is fed to a linear prediction analysis circuit 2 and also to a subframe division circuit 3.

The linear prediction analysis circuit 2 performs linear prediction analysis of the input speech signal, and supplies obtained spectral parameter to a weighting filter 4, a synthesis filter 14 and a weighting filter 15 in an overlap signal generation circuit 5, an influence signal subtraction circuit 6, an adaptive codebook search circuit 7, an excitation codebook search circuit 8, a gain codebook search circuit 9, and a spectral parameter quantizer 17.

The spectral parameter quantizer 17 converts the LPC coefficient set supplied from the linear prediction analysis circuit 2 into a spectral parameter to be quantized (but does not convert when quantizing the LPC coefficient set itself), and quantizes the spectral parameter (by converting the LPC coefficient set into a LSP (line spectrum pair) set and then vector-scalar quantizing the LSP set, for instance). Then, the spectral parameter quantizer 17 converts the spectral parameter obtained by the quantization into an LPC coefficient set and supplies the LPC coefficient set thus obtained to the influence signal subtraction circuit 6, and adaptive, excitation and gain codebook search circuits 7, 8 and 9. Further, an index of the quantized spectral parameter is supplied to a multiplexer 13.

The weighting filter 4, receives from the subframe division circuit 3, the input speech signal divided into the subframe length (of 8 msec., for instance), executes perceptual weighting of the input speech signal of the subframe length in accordance with formula (1) by using the non-quantized LPC coefficient set of the present subframe input from the linear prediction analysis circuit 2, and feeds the data thus obtained to the connection circuit 16.

The synthesis filter 14 produces a synthetic signal for the overlap length with the input speech signal of the present subframe input from the subframe division circuit 3 as an initial value, with the excitation signal set to zero, and using the non-quantized LPC coefficient set of the next subframe input from the linear prediction analysis circuit 2, and feeds the synthetic signal to the weighting filter 15.

The weighting filter 15 executes weighting of the input signal from the synthesis filter 14 in accordance with formula (1) by using the non-quantized LPC coefficient set of the next subframe supplied from the linear prediction analysis circuit 2, and supplies the weighted input signal to the connection circuit 16. Here, it is possible to alternatively use the quantized LPC coefficient set supplied from the spectral parameter quantizer 17 in lieu of the non-quantized LPC coefficient set.

The connection circuit 16 connects the signal supplied from the weighting filter 15 to the trailing end of the signal supplied from the weighting circuit 4, and supplies the resultant signal to the influence signal subtraction circuit 6.

The influence signal subtraction circuit 6 calculates an influence signal from the previous subframe by using the quantized LPC coefficient sets of the present and next subframes supplied from the spectral parameter quantizer 17 and executes weighting by using the non-quantized LPC coefficient sets of the present and next subframes supplied from the linear prediction analysis circuit 2, thus obtaining a weighted influence signal. Then, the influence signal subtraction circuit 6 subtracts the weighted influence signal from the signal supplied from the connection circuit 16 and supplies the resultant difference signal to the adaptive, excitation and gain codebook search circuits 7, 8 and 9. The weighting may be executed by using the quantized LPC coefficient set output from the spectral parameter quantizer 17 in lieu of the non-quantized LPC coefficient set as well.

The adaptive codebook search circuit 7 calculates an error $E_a$ in accordance with formula (5) by using the signal supplied from the influence signal subtraction circuit 6, the non-quantized LPC coefficient sets of the present and next subframes supplied from the linear prediction circuit 2, the quantized LPC coefficient sets of the present and next subframes supplied from the spectral parameter quantizer 17 and the adaptive codevector supplied from the adaptive codebook 10, and executes search of an adaptive codevector which minimizes the error $E_a$. Thus selected adaptive codevector is supplied to the excitation and gain codebook search circuits 8 and 9 and the delay d of the selected adaptive codevector is supplied to the multiplexer 13.

The excitation codebook search circuit 8 calculates an error $E_e$ in accordance with formulae (9) to (11) by using the signal supplied from the influence signal subtraction circuit 6, the non-quantized LPC coefficient sets of the present and next subframes supplied from the linear prediction analysis circuit 2, the quantized LPC coefficient sets of the present and next subframes supplied from the spectral parameter quantizer 17, the selected adaptive codevector supplied from the adaptive codevector search circuit 7 and excitation codevector supplied from the excitation codebook 11, and executes search of an excitation codevector which minimizes the error $E_e$. Then, the excitation codebook search circuit 8 supplies the excitation codevector thus selected to the gain codebook search circuit 9 and also supplies an index of the selected excitation codevector to the multiplexer 13. To reduce the amount of operations in the calculation of $E_e$, it is possible to obtain an auto-correlation of weighted synthetic signal for expanded excitation codevector signal $se_i$ in accordance with the following formula (13) on the basis of an auto-correlation approximation method, which is disclosed in a treatise by M. Trancoso and B. Atal and entitled "Efficient Search Procedures for Selecting the Optimum Innovation in Stochastic Coders", IEEE Trans. Acoust., Speech, Signal Processing, vol. 38, p—p 385–396

(literature 3).

$$<se_i,se_i>_{Ls+Lo} = hh(0)ee_i(0) + 2\sum_{l=1}^{im-1} hh(l)ee_i(l) \quad (13)$$

In this formula, hh is an auto-correlation function of the impulse response of a weighting synthesis filter WS, which is formed from a synthesis filter S using the quantized LPC coefficient set of the present subframe and a weighting filter W using the non-quantized LPC coefficient set of the present subframe, $ee_i$ is an auto-correlation function of the excitation codevector of index i, and im is the impulse response length.

To reduce the amount of operations, the cross-correlation between the weighted synthetic signal for the expanded excitation codevector $se_i$ and a given vector v, may be obtained in accordance with the following formula (14).

$$<v,se_i>_{Ls+Lo}=<H^T v,e_i>_{Ls} \quad (14)$$

Here, H is the impulse response matrix of the weighting synthesis filter WS, and $H^T$ is the transposed matrix of H.

It is possible to obtain the cross-correlation between the weighted synthetic signal for the expanded adaptive codebook $sa_d$ and a given vector v likewise in accordance with the following formula (15).

$$<v,s\alpha_d>_{Ls+Lo}=<H^T v,\alpha_d>_{Ls} \quad (15)$$

The gain codebook search circuit 9 executes search of a gain codevector which can minimize the error $E_g$ in accordance with formula (12) by using the signal supplied from the influence signal subtraction circuit 6, the non-quantized LPC coefficient sets of the present and next subframes supplied from the linear prediction analysis circuit 2, the quantized LPC coefficient sets of the present and next subframes supplied from the spectral parameter quantizer 17, the selected adaptive codevector supplied from the adaptive codebook search circuit 7, the selected excitation codevector supplied from the excitation codebook search circuit 8 and the gain codevector supplied from the gain codebook 12. The gain codebook search circuit 9 supplies the gain codevector thus selected to the gain codebook search circuit 9 and also supplies an index of the selected gain codevector to the multiplexer 13.

While in this embodiment uses perceptually weighted, non-quantized LPC coefficient sets in the adaptive, excitation and gain codebook search circuits 7, 8 and 9, it is possible to use, alternatively, the quantized LPC coefficient set supplied from the spectral parameter quantizer 17.

Further, while in this embodiment the same overlap length is set for the adaptive, excitation and gain codebook search circuits 7 to 9, it is also possible to set different overlap lengths for these circuits.

As has been described in the foregoing, in the system according to the present invention, to search the adaptive, excitation and gain codebooks, a perceptually weighted signal having the subframe length is obtained by using an input speech signal and spectral parameter determined as a result of the linear prediction analysis of the input speech signal, an overlap signal having a predetermined length is obtained by using the perceptually weighted signal and spectral parameter, and the adaptive, excitation and gain codebooks are searched by using a signal obtained by connecting the overlap signal to the trailing end of the perceptually weighted signal.

As a result, the speech signal that is represented by the adaptive, excitation and gain codevectors of the present subframe consists of the input speech signal of the present subframe and a influence signal based on the present subframe input speech signal and a non quantized LPC coefficient set of the next subframe. In addition by using an influence signal of the present subframe input speech signal on the next subframe, the distortion of the block boundary of block coding that is generated by coding for each subframe, can be reduced more effectively than in the prior art system using the next subframe input speech signal as the overlap signal (i.e., system disclosed in literature 3).

What is claimed is:

1. A speech coding system comprising:

a linear prediction analysis circuit for developing spectral parameters for subframes of an input speech signal divided at predetermined intervals in each frame;

an adaptive codebook;

an excitation codebook;

a gain codebook;

a first weighting filter for producing a perceptually weighted speech signal using said input speech signal and said spectral parameters of a present sub-frame; and an overlap signal generation circuit further comprising:

a synthesis filter; and a second weighting filter;

wherein a zero input response of the synthesis filter is developed for a predetermined length by providing the input speech signal of said present subframe as an initial value, and wherein said second weighting filter weights said zero input response to produce at least one overlap signal based on spectral parameters for a next subframe, and wherein optical codevectors are searched from said adaptive, excitation and gain codebooks according to a signal obtained by connecting said overlap said overlap signal to a trailing end of said perceptually weighted speech signal.

2. The speech coding system as set forth in claim 1, wherein in a search of said adaptive, excitation and gain codebooks the, respective lengths of said overlap signal to be connected to the trailing end of said perceptually weighted speech signal is set to a predetermined value for each said codebook.

3. A speech coding system comprising:

a linear prediction analysis means for executing linear prediction analysis on a plurality of subframes of a divided input speech signal to produce LPC coefficient sets for said subframes;

a spectral parameter quantizer means for quantizing spectral parameters corresponding to said LPC coefficient sets;

a first weighting filter means for executing a perceptual weighting of a subframe speech signal based on a non-quantized LPC coefficient set of a present subframe;

a synthesis filter means for producing a synthetic signal of a predetermined overlap length by setting the input speech signal of the present subframe speech signal as an initial value and setting an excitation signal to zero based on a non-quantized LPC coefficient set of a next subframe speech signal;

a second weighting filter means for weighting said synthetic signal based on the non-quantized LPC coefficient set of the next subframe;

a connection circuit means for connecting the signal output from said second weighting filter means to a trailing end of the signal supplied from said first weighting filter means;

an influence signal subtraction circuit means for producing a codebook signal by developing an influence signal from a previous subframe based on a quantized LPC coefficient set of the present subframe and a LPC coefficient set of the next subframe, for weighting the influence signal based on the non-quantized LPC coefficient sets of the present and next subframes to obtain a weighted influence signal, and for subtracting the weighted influence signal from the output signal from the connection circuit means;

an adaptive codebook search means for searching for an optimal adaptive codevector from an adaptive codebook based on the codebook signal supplied from said influence signal subtraction circuit means, the non-quantized LPC coefficient sets of the present and next subframes supplied from said linear prediction means, the quantized LPC coefficient sets of the present and next subframe supplied from said spectral parameter quantizer means and an adaptive codevector supplied from said adaptive codebook;

an excitation codebook search means for searching for an optimal adaptive codevector from an excitation codevector based on the codebook signal supplied from said influence signal subtraction means, the non-quantized LPC coefficient sets of the present and next subframes supplied from the linear prediction analysis means, the quantized LPC coefficient sets of the present and next subframes supplied from the spectral parameter quantizer means, the optimal adaptive codevector supplied from the adaptive codevector search means and an excitation codevector supplied from the excitation codebook, and for supplying the searched excitation codevector to said gain codebook search means and for also supplying an index of the searched excitation codevector to a multiplexer means.

4. The speech coding system as set forth in claim 3, wherein said non-quantized LPC coefficient set of the next subframe is a non-quantized LPC coefficient set of the present subframe, and said quantized LPC coefficient set of the next subframe is a quantized LPC coefficient set of the present subframe when the present subframe is the final subframe in a frame.

5. The speech coding system as set forth in claim 3, wherein the quantized LPC coefficient set supplied from said spectral parameter quantizer means is used in lieu of the non-quantized LPC coefficient set in said second weighting filter means.

6. The speech coding system as set forth in claim 3, wherein said weighting in said influence signal subtraction means is executed by using the quantized LPC coefficient set supplied from the spectral parameter quantizer means.

7. The speech coding system as set forth in claim 3, wherein the length of the overlap is set at a predetermined value for each said adaptive, excitation and gain codebook search means.

* * * * *

UNITED STATES PATENT AND TRADEMARK OFFICE

CERTIFICATE OF CORRECTION

PATENT NO. : 5,598,504
DATED : January 28, 1997
INVENTOR(S) : Toshiki MIYANO

It is certified that error appears in the above-indentified patent and that said Letters Patent is hereby corrected as shown below:

On the Title Page, please delete the following:

"[30] Foreign Application Priority Data

March 15, 1993 [JP] Japan ..... 008736"

Signed and Sealed this

Second Day of September, 1997

*Attest:*

*Attesting Officer*

BRUCE LEHMAN

*Commissioner of Patents and Trademarks*